US007258159B2

(12) United States Patent
Kume et al.

(10) Patent No.: US 7,258,159 B2
(45) Date of Patent: Aug. 21, 2007

(54) HEAT EXCHANGER

(75) Inventors: Takayuki Kume, Tochigi (JP); Keiji Maezawa, Oyama (JP)

(73) Assignee: Calsonic Kansei Corporation, Tokyo (JP)

( * ) Notice: Subject to any disclaimer, the term of this patent is extended or adjusted under 35 U.S.C. 154(b) by 59 days.

(21) Appl. No.: 11/177,321

(22) Filed: Jul. 11, 2005

(65) Prior Publication Data

US 2006/0011323 A1 Jan. 19, 2006

(30) Foreign Application Priority Data

Jul. 16, 2004 (JP) ..... 2004-210006

(51) Int. Cl.
*F28F 9/00* (2006.01)

(52) U.S. Cl. ..... 165/11.1; 165/78; 165/153; 165/175

(58) Field of Classification Search ..... 165/11.1, 165/78, 148–153, 172, 175, 176
See application file for complete search history.

(56) References Cited

U.S. PATENT DOCUMENTS 5,875,834 A * 3/1999 Brooks ..... 165/11.1
6,796,374 B2 * 9/2004 Rong ..... 165/109.1
2002/0079093 A1 * 6/2002 Rong ..... 165/153

FOREIGN PATENT DOCUMENTS

JP 9-152294 A 6/1997

* cited by examiner

*Primary Examiner*—Teresa J. Walberg
(74) *Attorney, Agent, or Firm*—Foley & Lardner LLP

(57) ABSTRACT

A heat exchanger includes a plurality of flat tubes. The flat tubes have a pair of tube sheets facing each other and joined together. The tube sheets have a flat part, a recess part, and a cylindrical tank. The tube sheet is one of a first tube sheet and a second tube sheet. The first tube sheet has a first type of tank. The second tube sheet has the first type of tank and a second type of tank. Identifiers are provided at each end of the second tube sheet. The identifiers distinguishing the second tube sheet from the first tube sheet when viewed from externally of the stacked flat tubes. A mark provided at one of the identifiers of the second tube sheet.

12 Claims, 11 Drawing Sheets

14
16
15
16
14
16
15
16
E
22
22
D
C
B
A
14
11
1A
1A
100
11
10
12
17
14
E
D
C
B
A
1B
102(OUT)
101(IN)
100
17

HEAT EXCHANGER

CROSS REFERENCE TO RELATED APPLICATIONS AND INCORPORATION BY REFERENCE

This application is based upon and claims the benefit of priority from the prior Japanese Patent Applications No. 2004-210006, filed on Jul. 16, 2004; the entire contents of which are incorporated herein by reference.

BACKGROUND OF THE INVENTION

1. Field of the Invention

The present invention relates to a heat exchanger with a plurality of tube sheets stacked in layers.

2. Description of Related Art

A known heat exchanger has a plurality of flat tubes stacked in layers. In such a heat exchanger, each flat tube has a coolant passage extending in a longitudinal direction and a cylindrical tank protruding in the stacking direction from each side of each longitudinal end of the coolant passage. The tanks of the stacked flat tubes are joined to form a header tank.

Each flat tube consists of two tube sheets that are arranged face to face and are joined together. Each tube sheet has a flat part, a recess part that is depressed from the flat part to form the coolant passage of the flat tube when joined with a counterpart tube sheet, and a cylindrical tank that protrudes from each longitudinal end of the recess part to serve as the tank of the flat tube.

The heat exchanger must form therein a route for passing a coolant. For this, a modified tube sheet is arranged at a predetermined location in the heat exchanger. The modified tube sheet has a modified tank that is different from a normal tank provided for a normal tube sheet. The modified tank has a partition to close an opening of the tank, or a throttle to reduce the opening of the tank. Such a modified tube sheet with a modified tank has the same or similar external shape as the normal tube sheet. It is difficult, therefore, to identify, from an external view of the heat exchanger, the modified tube sheets from among the stacked tube sheets of the heat exchanger. To solve the problem, Japanese Unexamined Patent Application Publication No. Hei-9-152294 discloses a heat exchanger that puts a mark such as a rib or a notch on a modified tube sheet. This heat exchanger allows a person to identify, from an external view of the heat exchanger, the modified tube sheet in the heat exchanger.

SUMMARY OF THE INVENTION

In an inspection work carried out during the manufacturing of a heat exchanger, an inspector needs to identify, from the exterior of the heat exchanger, the location of a modified tube sheet from among stacked tube sheets in the heat exchanger, as well as the end of the modified tube sheet where a modified tank with a partition or a throttle is present. Such identification of the modified tube sheet is also carried out after the manufacturing of the heat exchanger when installing the heat exchanger in, for example, a vehicle. If the modified tube sheet is not identifiable form the exterior of the heat exchanger, a worker will be unable to correctly install the heat exchanger in the vehicle.

To solve the problem, the modified tube sheet may be provided with a mark such as a notch or a rib at the end of the modified tube sheet where the partition or throttle is present. This configuration may allow a person to identify the location of the partition or throttle only if the person checks each side of the heat exchanger. Namely, this configuration forces the person to turn over the heat exchanger to inspect each side of the heat exchanger. This is troublesome for the person.

In consideration of the problems, the present invention provides a heat exchanger that allows a person to understand an internal structure (the locations of partitions and throttles) of the heat exchanger by inspecting only one side of the heat exchanger from the exterior of the heat exchanger.

A first aspect of the present invention provides a heat exchanger having a plurality of flat tubes stacked in layers. Each of the plurality of flat tubes has a pair of tube sheets facing each other and joined together. The tube sheets have a flat part, a depressed recess part having end portions and extending in a longitudinal direction, and a cylindrical tank protruding from the end portions of the recess part. The tube sheet is one of either a first tube sheet or a second tube sheet. The first tube sheet has a first type of tank positioned at each end thereof. The second tube sheet has a first type of tank at one end portion of the recess part and a second type of tank at the other end portion of the recess part. Identifiers are provided at each end of the second tube sheet. The identifiers distinguish the second tube sheet from the first tube sheet when viewed from externally of the stacked flat tubes. A mark is provided at one of the identifiers of the second tube sheet.

A second aspect of the present invention provides a heat exchanger having a plurality of flat tubes stacked in layers. Each of the plurality of flat tubes has a pair of tube sheets facing each other and joined together. The tube sheets have a flat part, a depressed recess part having end portions and extending in a longitudinal direction, and a cylindrical tank protruding from the end portions of the recess part. The tube sheet is one of either a first tube sheet or a second tube sheet. The first tube sheet has a first type of tank positioned at each end thereof. The second tube sheet has a first type of tank at one end portion of the recess part and a second type of tank at the other end portion of the recess part. Identifiers are provided at each end of the second tube sheet. The identifiers distinguish the second tube sheet from the first tube sheet when viewed from externally of the stacked flat tubes. A first mark is provided at one of the identifiers of the second tube sheet. A second mark is provided at the other of the identifiers of the second tube sheet.

DETAILED DESCRIPTION OF EMBODIMENTS

Figures 1A, 1B, 1C, 1D:
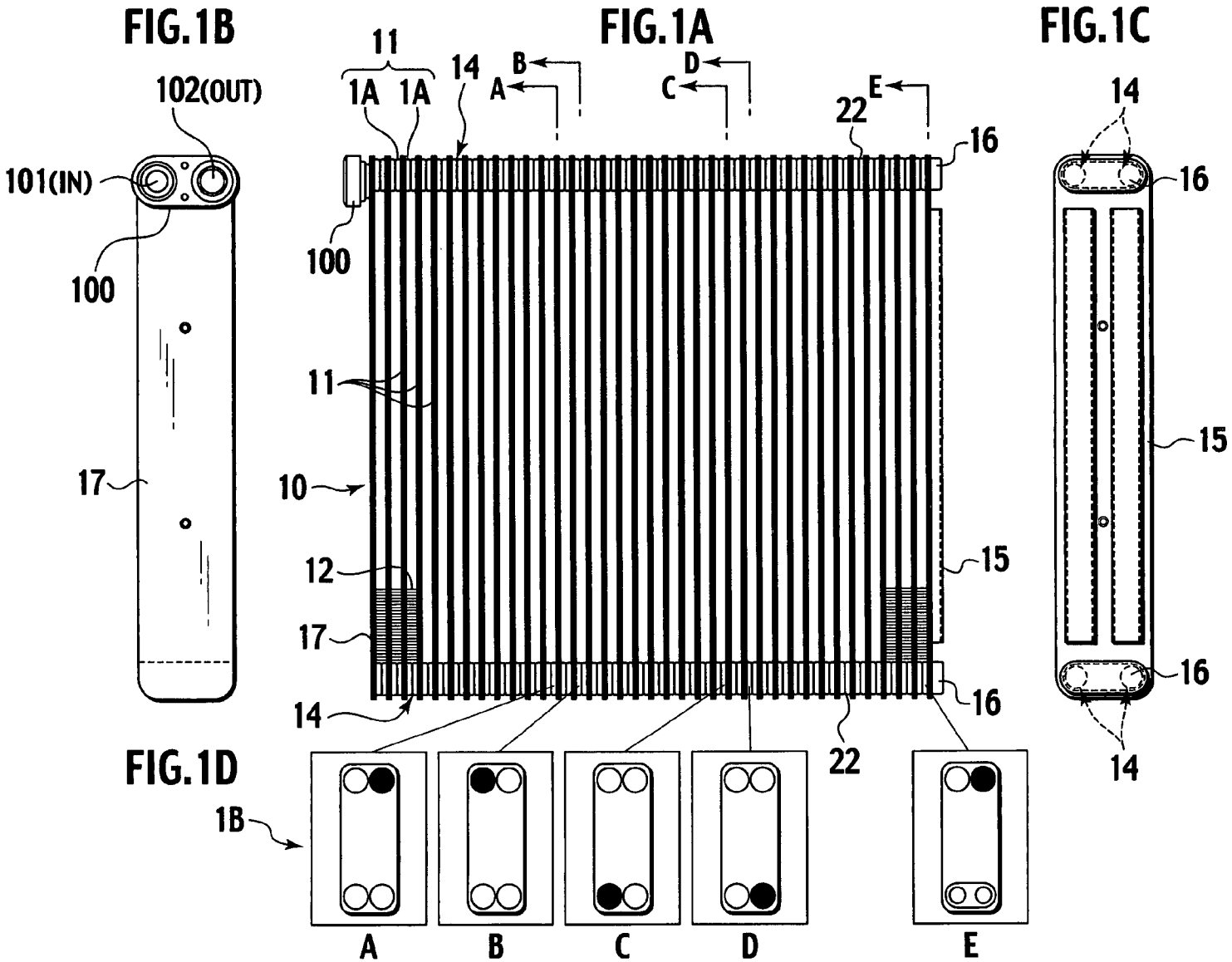
FIG. 1A is a front view seen in an air flowing direction, showing a heat exchanger according to a first embodiment of the present invention.
FIG. 1B is a left side view showing the heat exchanger according to the first embodiment.
FIG. 1C is a right side view showing the heat exchanger according to the first embodiment.
FIG. 1D shows sectional views taken at the positions of arrows A, B, C, D, and E shown in FIG. 1A with a black circle indicating a second tank of closed type and a white circle indicating a first tank with a through opening.

Embodiments of the present invention will be explained with reference to the accompanying drawings.

First Embodiment

FIGS. 1A to 1D show a heat exchanger 10 according to a first embodiment of the present invention. The heat exchanger 10 has a plurality of flat tubes 11 stacked in layers with fins 12 interposed between the layers of the flat tubes 11. A flat tube 11 has a coolant passage 13 (FIGS. 2 and 3) formed in the flat tube 11 and extending in a longitudinal direction (vertical direction in FIG. 1A) and a cylindrical tank 22 protruding from each longitudinal end portion of the coolant passage 13 in the stacking direction (horizontal direction in FIG. 1A).

The flat tubes 11 are stacked in layers and the tanks 22 of the adjacent tubes 11 are connected to each other to communicate with each other. At each end (each of the top and bottom ends in FIG. 1A) of the heat exchanger 10, the connected tanks 22 form a header tank 14 extending in the stacking direction (horizontal direction in FIG. 1A). The header tanks 14 merge and distribute a coolant through the coolant passages 13.

Figure 2:
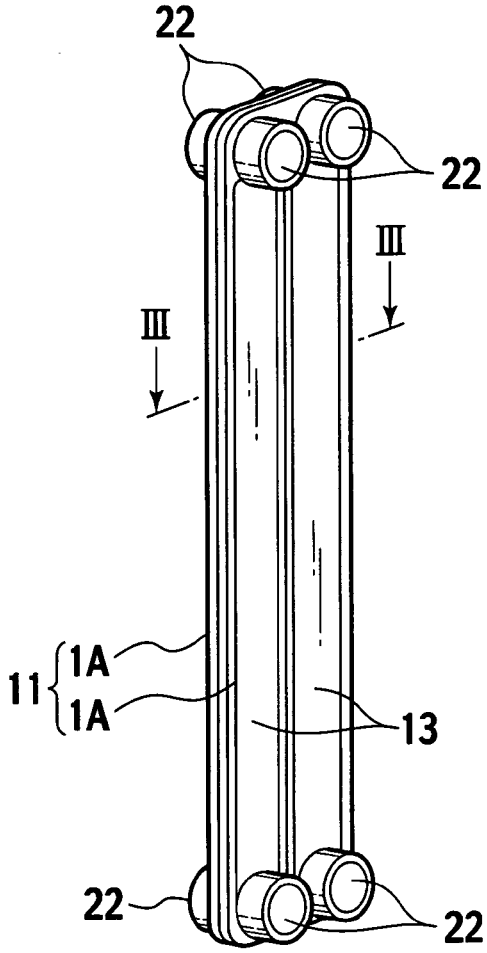
FIG. 2 is a perspective view showing a flat tube of the heat exchanger according to the first embodiment.
Figure 3:
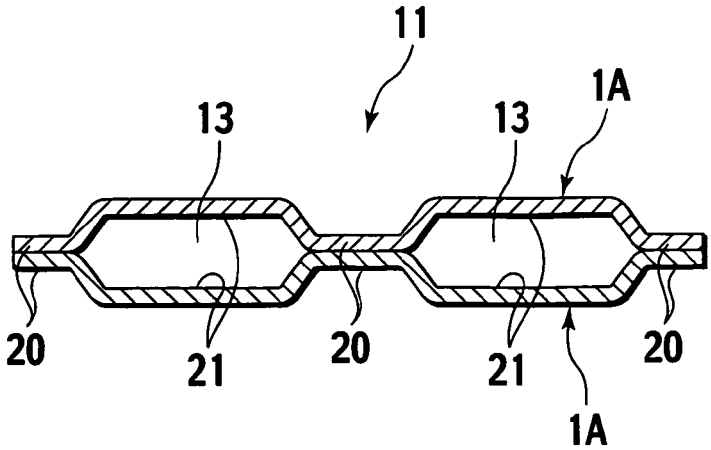
FIG. 3 is a sectional view along a line III-III of FIG. 2.

According to the first embodiment, each flat tube 11 has two separate coolant passages 13 as shown in FIGS. 2 and 3. Accordingly, the flat tube 11 has two tanks 22 at each end. Namely, there are two header tanks 14 at the top end of the heat exchanger 10 and two header tanks 14 at the bottom end thereof as shown in FIG. 1A.

The other parts of the heat exchanger 10 will be explained. An end plate 15 is arranged at a right end (as shown in the drawing) of the heat exchanger 10. A passage 16 is formed in the end plate 15, to connect the top and bottom header tanks 14 to each other. An end plate 17 is formed at a left end (as shown in the drawing) of the heat exchanger 10. A connector 100 is fixed to the end plate 17 and is connected to the left ends of the top header tanks 14. A coolant inlet 101 is formed on the connector 100 to communicate with one of the top header tanks 14. A coolant outlet 102 is formed on the connector 100 to communicate with the other top header tank 14.

Figure 4A:
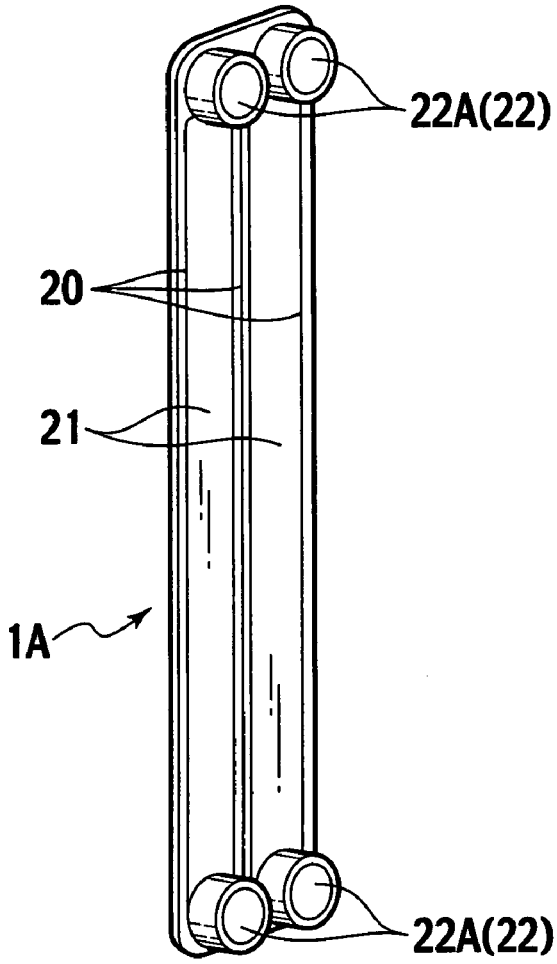
FIG. 4A is a perspective view showing a first tube sheet to form a flat tube.
Figure 4B:
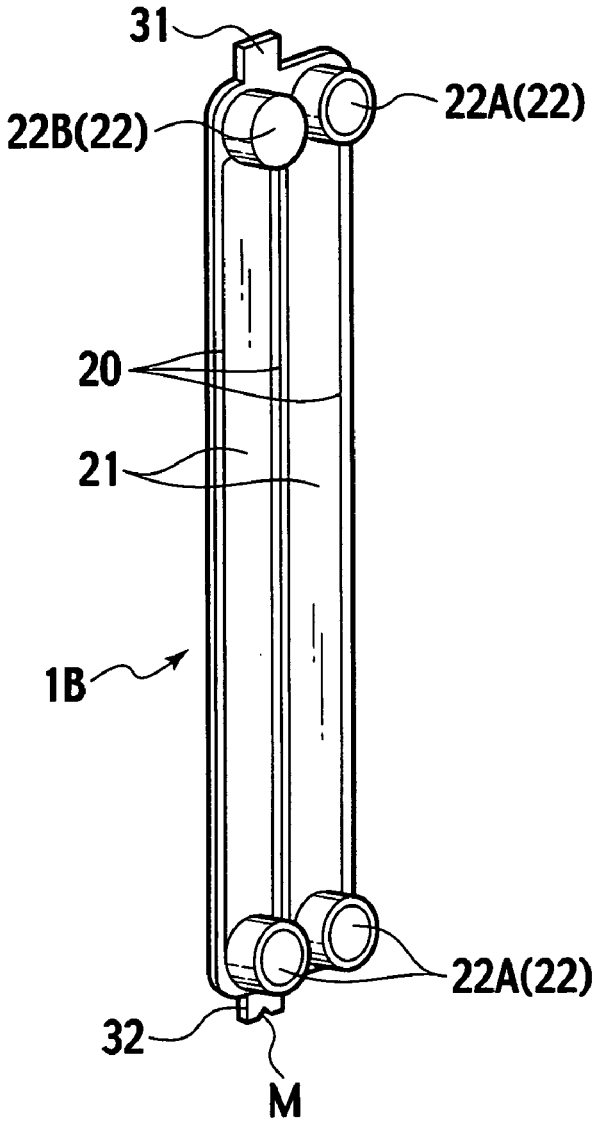
FIG. 4B is a perspective view showing a second tube sheet to form a flat tube.
Figure 5A:
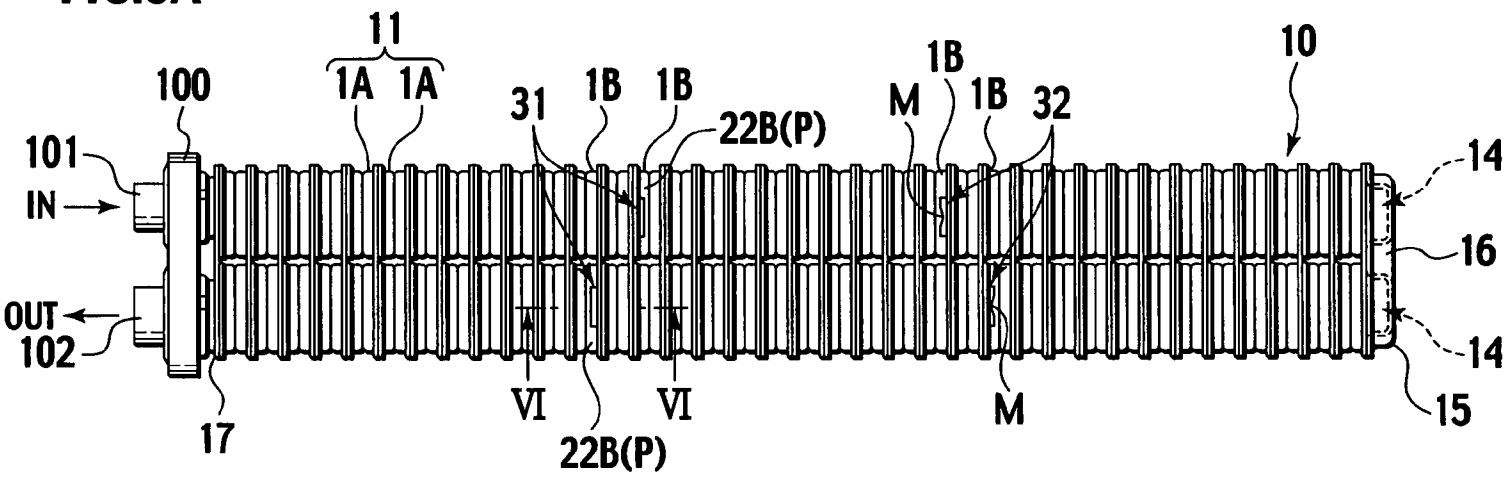
FIG. 5A is a top view showing the heat exchanger of FIG. 1.
Figure 5B:
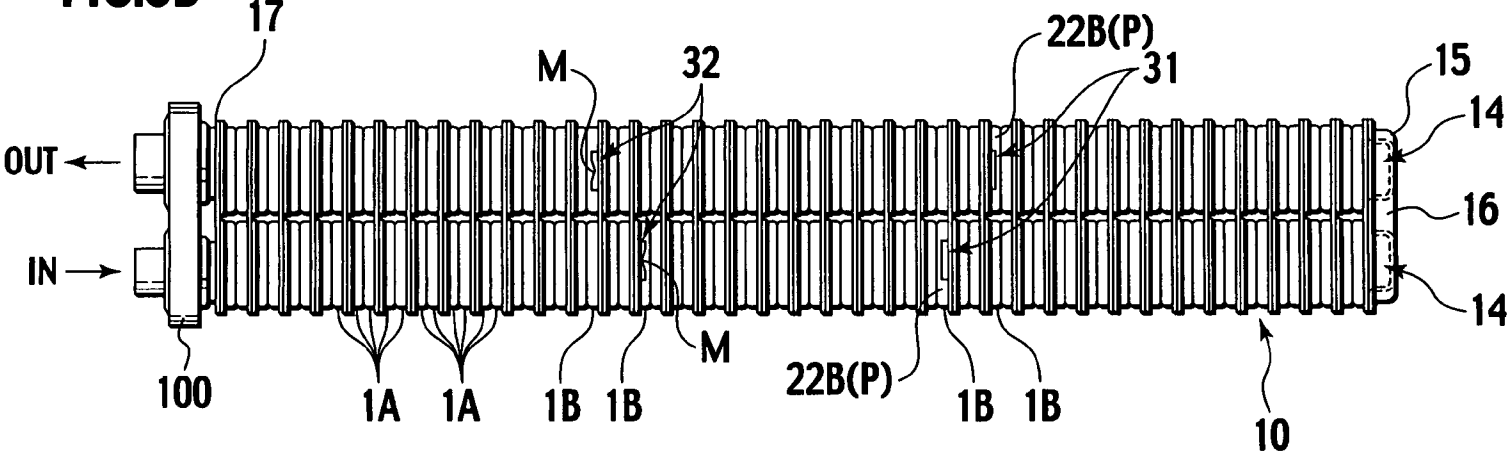
FIG. 5B is a bottom view showing the heat exchanger of FIG. 1.

Tube sheets that form the flat tube 11 will be explained with reference to FIGS. 4A and 4B.

A flat tube 11 is formed by arranging two metal tube sheets 1A face to face and by joining the two sheets together. The first embodiment employs a first tube sheet 1A shown in FIG. 4A and a second tube sheet 1B shown in FIG. 4B.

The first tube sheet 1A has a flat part 20, a recess part 21 that is depressed from the flat part 20 and to form the coolant passage 13 of the flat tube 11, and a cylindrical tank 22 protruding from each longitudinal end portion of the recess part 21, in a thickness direction, to form the tank 22 of the flat tube 11. The tank of the tube sheet is represented with the same reference numeral "22" as that used for the tank of the flat tube 11.

The tube sheet 1A has two recess parts 21 and four tanks 22, to form the flat tube 11. The four tanks 22 of the tube sheet 1A are first tanks 22A, each having a communication opening.

The second tube sheet 1B has substantially the same shape as the first tube sheet 1A. Namely, the second tube sheet 1B has a flat part 20, two coolant passing recess parts 21, and four cylindrical tanks 22. Among the four cylindrical tanks 22 of the second tube sheet 1B, one is a second type of tank 22B that is closed and the other three are the first type tanks 22A, each having a communication opening.

The second tube sheet 1B is arranged at a predetermined location in the stacked flat tubes 11, to form a partition (with the second tank 22B of the second tube sheet 1B) in the header tank 14 of the heat exchanger 10. This structure defines a coolant passing route in the heat exchanger 10.

Opposite ends of the second tube sheet 1B have projections (as identifiers) 31 and 32, respectively. The projections 31 and 32 allow a person to easily understand, from an external inspection of the heat exchanger 10, the location of the second tube sheet 1B in the heat exchanger 10. The projections 31 and 32 have different shapes. According to the first embodiment, the projection 31 is at the end of the second tube sheet 1B where the closed second tank 22B is present. The projection 31 is not provided with a notch (as a mark) M. The projection 32 at the opposite end of the second tube sheet 1B is provided with the notch M. The projections 31 and 32 are formed close to one of the two coolant passing recess parts 21 that are provided with the second tank 22B.

Figure 6:
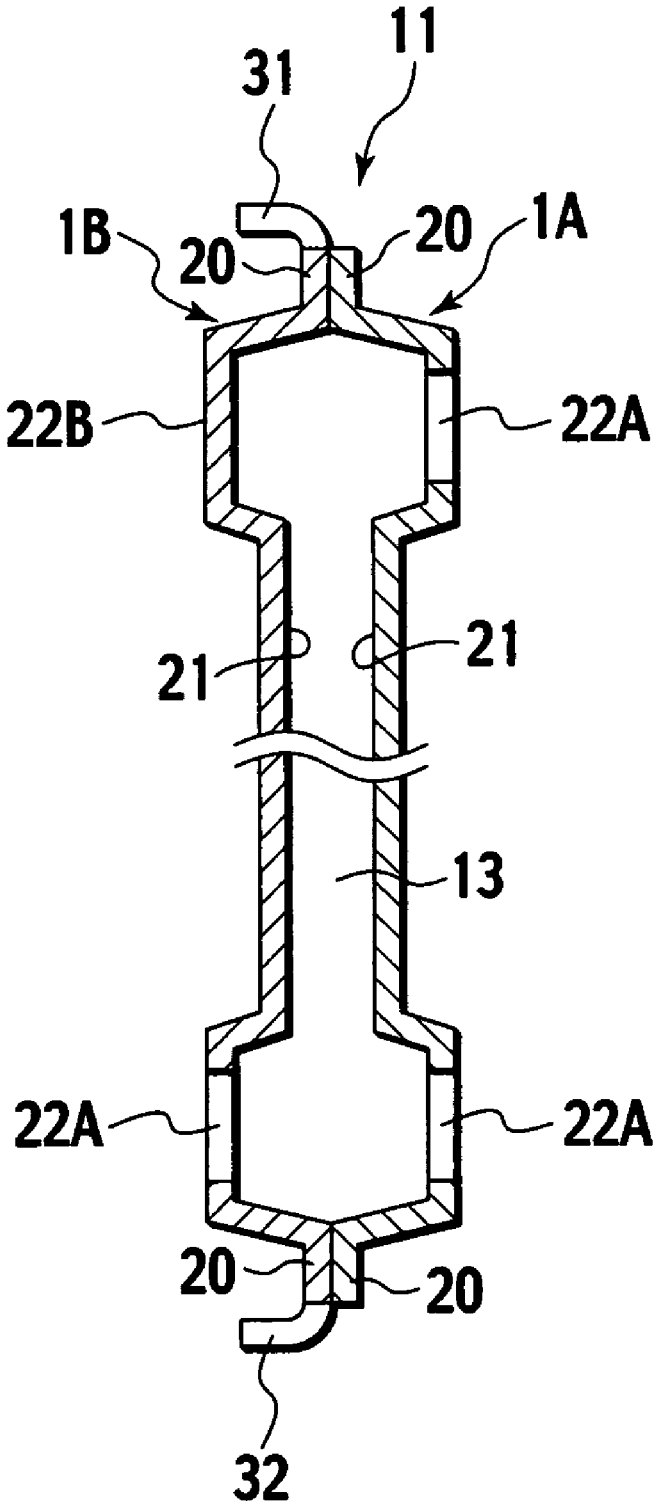
FIG. 6 is a sectional view along a line XI-XI of FIG. 5A, showing a modified tube.

By only viewing the exterior of the heat exchanger 10, a person can understand that the partition (second tank 22B) is present in the vicinity of the non-notched projection 31, or that the partition (second tank 22B) is present on the opposite end of the notched projection 32. The projections 31 and 32 may be bent as shown in FIG. 6 if required.

Operation of the first embodiment will be explained.

(1) The first tube sheet 1A and second tube sheet 1B have similar external shapes. The second tube sheet 1B, however, is provided with the identifiers 31 and 32 at each end thereof. Accordingly, by only observing one of the top and bottom ends of the heat exchanger 10, one can confirm the location of the second tube sheet 1B in the stacked flat tubes 11 of the heat exchanger 10. From the mark M on one of the identifiers 31 and 32, one can recognize which end of the second tube sheet 1B includes the second tank 22B. In this way, one can understand the internal structure of the heat exchanger 10 by inspecting only one end of the heat exchanger 10 from the outside. This results in simplifying inspection work carried out during the manufacturing of the heat exchanger 10, as well as installation work to install the heat exchanger 10 because one can easily recognize the orientation of the heat exchanger 10 from the identifiers 31 and 32.

(2) The mark M is provided at the end of the second tube sheet where the second tank is absent. A person inspects one side of the heat exchanger 10, and if the identifier 31 without the mark on the tube sheet 1B is observed, the person will determine that the partition (closed second tank 22B) is present at that end. If the person observes the identifier 32 with the mark M on the second tube sheet 1B, the person will recognize that the partition (closed second tank 22B) is present at the opposite end.

(3) The identifier projection 31 protrudes from each end of the second tube sheet 1B. The identifier projection 31 is a simple structure and can be formed in a process of forming (pressing) the tube sheet 1B.

(4) The mark M is the notch M. The identifier 31 is a simple structure and can be formed in a process of forming (pressing) the tube sheet 1B.

Second Embodiment

FIGS. 7A to 7C, 8A, and 8B show a heat exchanger according to a second embodiment of the present invention.

The first embodiment, mentioned above, employs one type of second tanks. The second embodiment employs two types of second tanks. The two types of second tanks are formed on different tube sheets. (According to a modified embodiment of the present invention, plurality types of second tanks may be formed on the same tube sheet.)

Figure 7C:
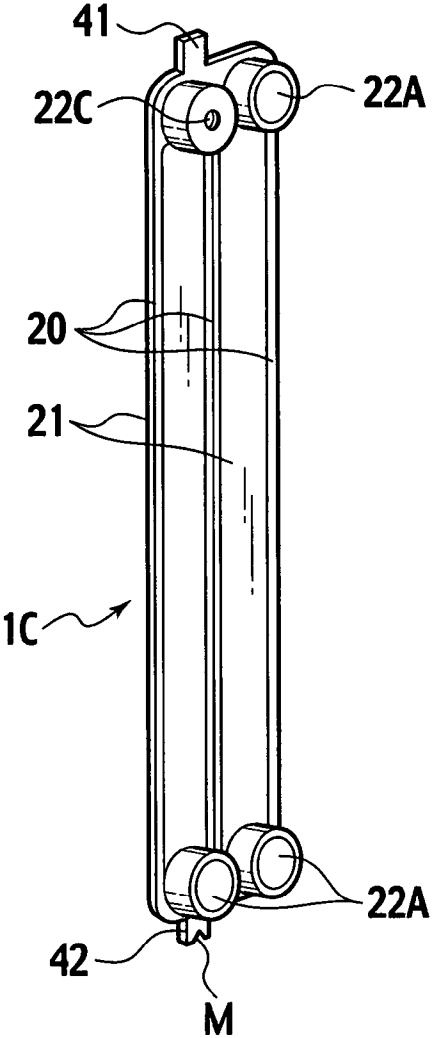
FIG. 7C is a perspective view showing a modified second tube sheet according to the second embodiment.
Figure 7B:
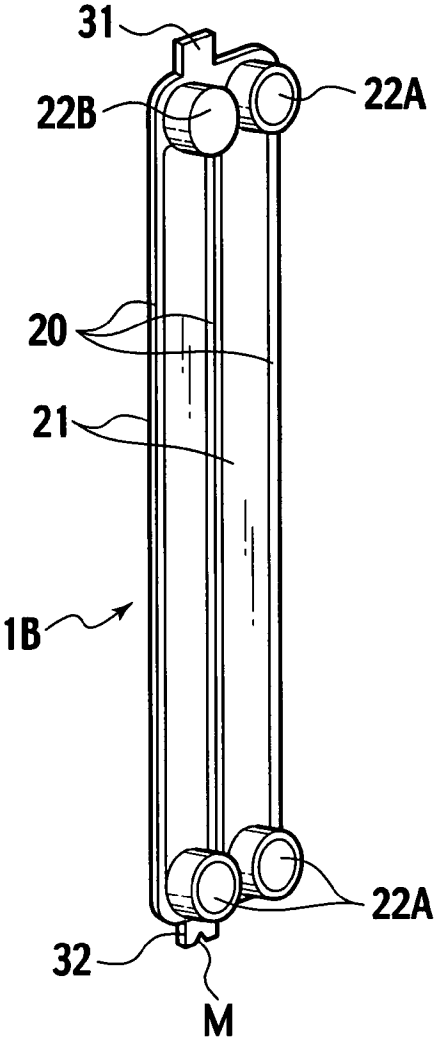
FIG. 7B is a perspective view showing a second tube sheet according to the second embodiment.
Figure 7A:
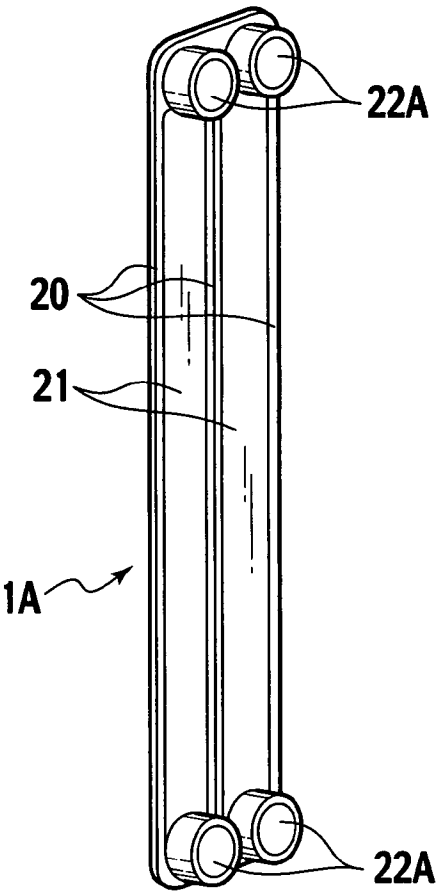
FIG. 7A is a perspective view showing a first tube sheet in a heat exchanger according to a second embodiment of the present invention.

The heat exchanger 10C according to the second embodiment employs three tube sheets, a first tube sheet 1A shown in FIG. 7A, a second tube sheet 1B shown in FIG. 7B, and a modified second tube sheet 1C shown in FIG. 7C. The first tube sheet 1A and second tube sheet 1B are the same as those of the first embodiment. The modified second tube sheet 1C has four tanks 22, among which one is a second tank 22C having a throttle and the remaining three are first tanks 22A.

As shown in FIG. 7C, ends of the modified second tube sheet 1C have projections (as identifiers) 41 and 42, respectively. The projections 41 and 42 are used to distinguish the modified second tube sheet 1C from the first tube sheet 1A. The projections 41 and 42 must also be distinguishable from the projections (as identifiers) 31 and 32 of the second tube sheet 1B. For this, the projections 41 and 42 are differed in size from the projections 31 and 32. Among the projections 41 and 42, the projection 41 is formed at the end of the second tube sheet 1C where the modified second tank 22C is present. The projection 41 is not provided with a mark M, to thereby serve as a first mark. The projection 42 at the opposite end has the mark M. The projections 41 and 42 are formed close to one of the two coolant passing recess parts 21 that are provided with the second tank 22C.

If a person sees the projection 41 without a notch at one end of the modified second tube sheet 1C, the person will understand that the second tank 22C is present at that end. If the person sees the projection 42 with the mark M at one end of the modified second tube sheet 1C, the person will understand that the second tank 22C is present at the opposite end.

Figure 8A:
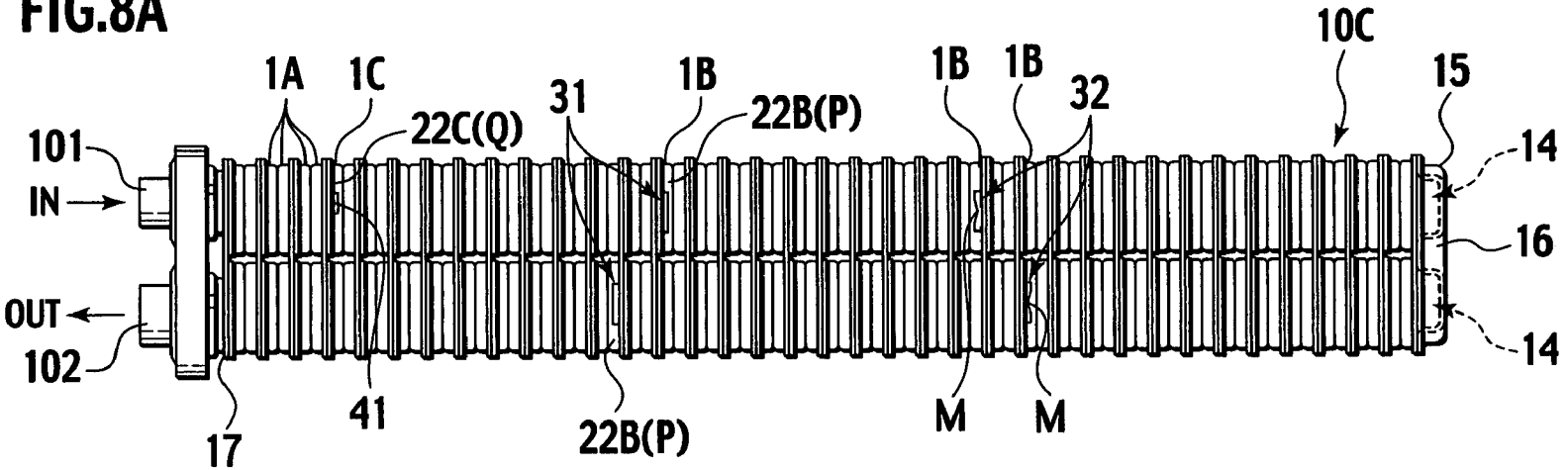
FIG. 8A is a top view showing the heat exchanger according to the second embodiment.
Figure 8B:
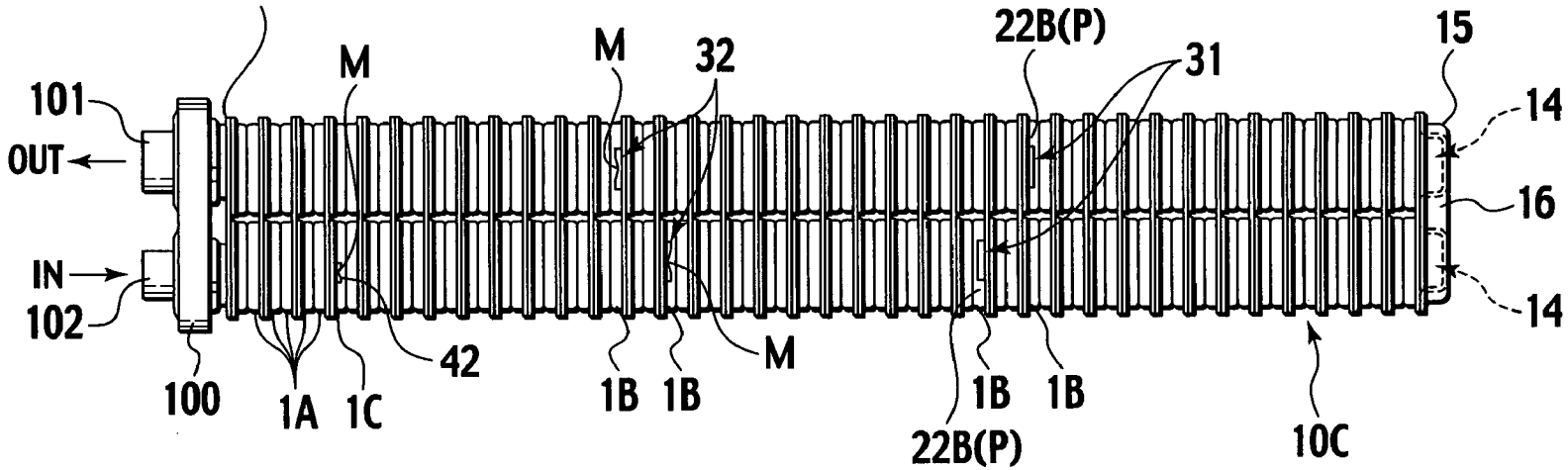
FIG. 8B is a bottom view showing the heat exchanger according to the second embodiment.

FIGS. 8A and 8B show the heat exchanger 10C with the tube sheets of FIGS. 7A to 7C stacked in layers, in which FIG. 8A is a top view and FIG. 8B is a bottom view.

The heat exchanger 10C includes the first tube sheets 1A and the second and modified second tube sheets 1B and 1C. The second and modified second tube sheets 1B and 1C are oriented in predetermined directions. At the location where the second tube sheet 1B is present, a header tank 14 of the heat exchanger 10C is partitioned with the second tank 22B, to define a coolant route in the heat exchanger 10C. At the location where the modified second tube sheet 1C is present, the modified second tank 22C forms a throttle in the coolant route. In FIGS. 8A and 8B, a mark P indicates the location of the partition formed with the second tank 22B, and a mark Q indicates the location of the throttle formed with the modified second tank 22C.

Operation of the second embodiment will be explained.

(1) The first tube sheet 1A, second tube sheet 1B and modified second tube sheet 1C have similar external shapes. The second tube sheet 1B, however, is provided with the identifiers 31 and 32 at each end thereof, and the modified second tube sheet 1C is provided with the identifiers 41 and 42 at each end thereof. Accordingly, only by observing one of the top and bottom ends of the heat exchanger 10C, one can confirm the locations of the second tube sheets 1B and 1C in the stacked flat tubes 11 of the heat exchanger 10C. The size of the identifiers 31 and 32 differs from the size of the identifiers 41 and 42, and therefore, one can distinguish the second tanks 22B and 22C (second tube sheets 1B and modified second tube sheets 1C) from each other according to the sizes thereof. From the mark M put on one of the identifiers 31 and 32, or one of the identifiers 41 and 42, one can determine the end of the second tube sheet 1B or modified second tube sheets 1C where the second tank 22B or 22C is present.

Therefore, even if there is a plurality of types of second tube sheets 1B and 1C, by inspecting only one side of the heat exchanger 10C from the outside, one can understand an internal structure (the locations of the second tanks 22B and modified second tanks 22C) of the heat exchanger 10C. In this way, the second embodiment allows a person to easily understand the internal structure of the heat exchanger 10C.

(2) The mark M is provided at the end of the second tube sheet 1B where the second tank 22B is absent. The mark M is provided at the end of the modified second tube sheet 1C where the modified second tank 22C is absent. Therefore, if a person sees the identifier 31 or 41 without the mark M when inspecting one end of the heat exchanger 10C, the person will understand that the partition or throttle (closed second tank 22B or throttled second tank 22C) is present at the end. If the person sees the identifier 32 or 42 with the mark M, the person will understand that the partition or throttle (closed second tank 22B or throttled second tank 22C) is present at the other end.

(3) The identifiers 31, 32, 41 and 42 are projections protruding from each end of the second tube sheets 1B and modified second tube sheets 1C. The identifiers 31, 32, 41 and 42 are simple structures and can be formed in a process of forming (pressing) the tube sheets 1B and modified second tube sheets 1C.

(4) The mark M is a notch. The mark M is a simple structure and can be formed in a process of forming (pressing) the tube sheets 1B and modified second tube sheets 1C.

If there is a plurality of types of second tanks to be identified like the second embodiment, at least one of the shape, size, and position of the identifiers is differed from type to type to identify the types of second tanks. Examples of this will be explained with reference to FIGS. 9A to 11C.

Figure 9A:
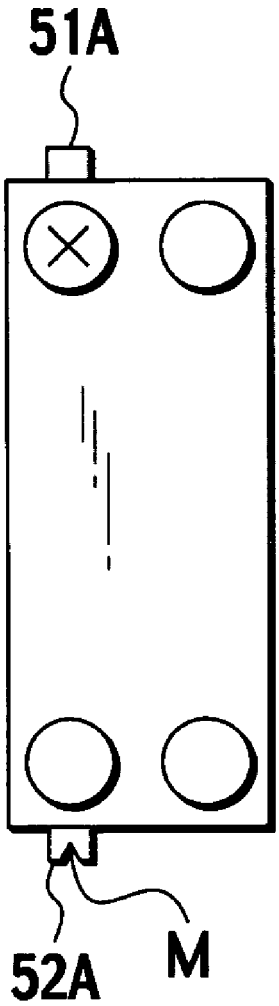
FIGS. 9A to 9C are views showing first examples of identifiers for identifying the types of second tube sheets.
Figure 9B:
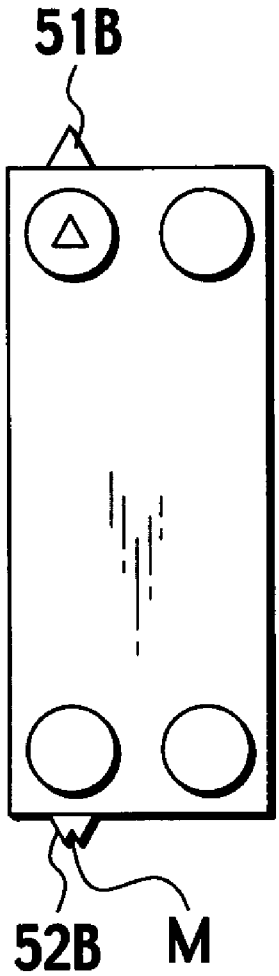
Figure 9C:
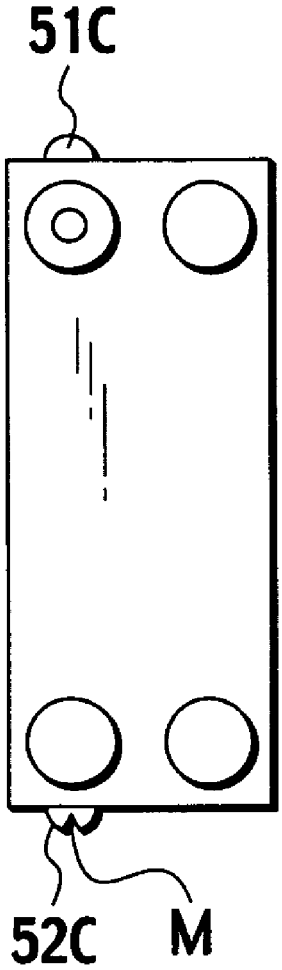

FIGS. 9A to 9C show projections 51A to 51C and 52A to 52C having different shapes (for example, square, triangle, and semicircle) to specify the types of second tanks (second tube sheets). Each projection is provided with or without a mark M to indicate whether the second tank is present at the end where the projection is formed or at the opposite end.

Figure 10A:
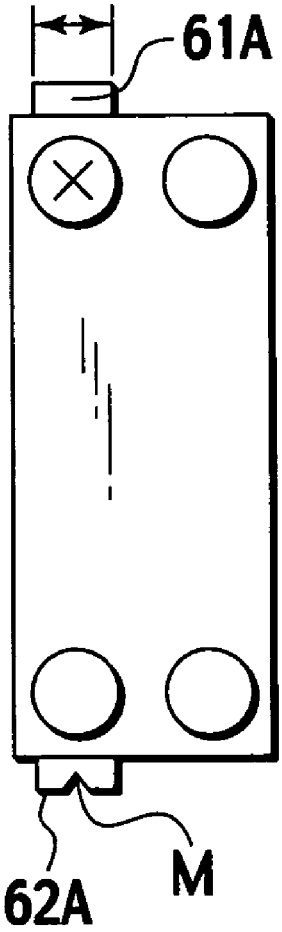
FIGS. 10A to 10C are views showing second examples of identifiers for identifying the types of second tube sheets.
Figure 10B:
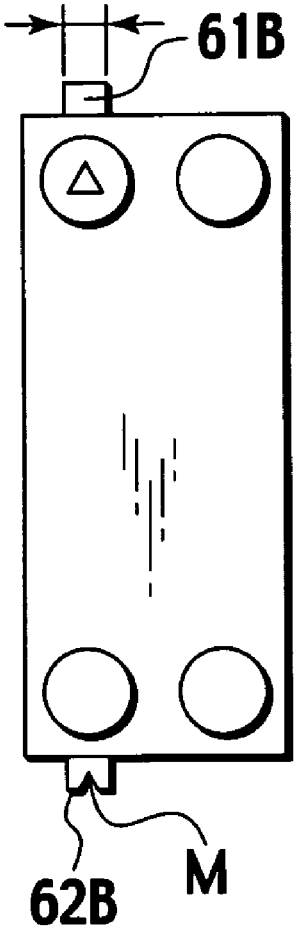
Figure 10C:
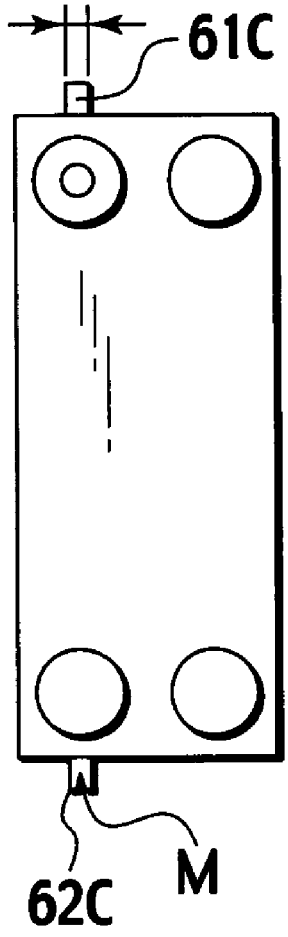

FIGS. 10A to 10C show projections 61A to 61C and 62A to 62C having different sizes (LA, LB, and LC) to specify the types of second tanks (second tube sheets). Each projection is provided with or without a mark M to indicate whether the second tank is present at the end where the projection is formed or at the opposite end.

Figure 11A:
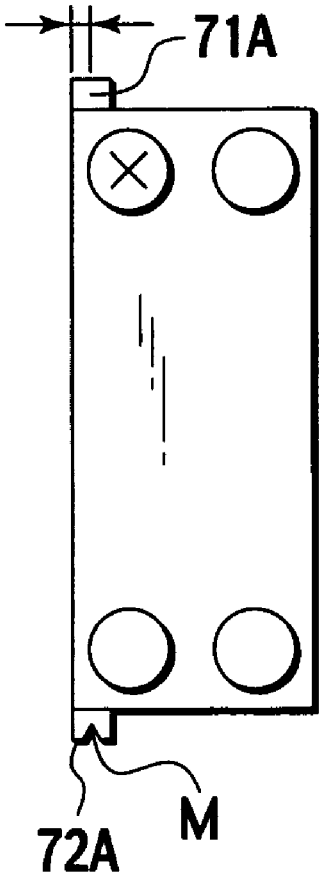
FIGS. 11A to 11C are views showing third examples of identifiers for identifying the types of second tube sheets.
Figure 11B:
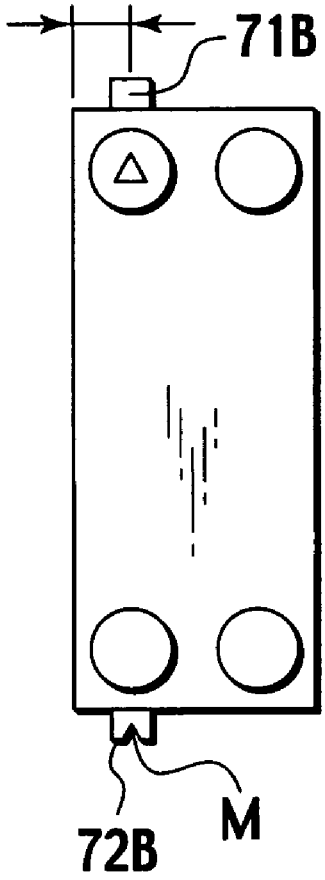
Figure 11C:
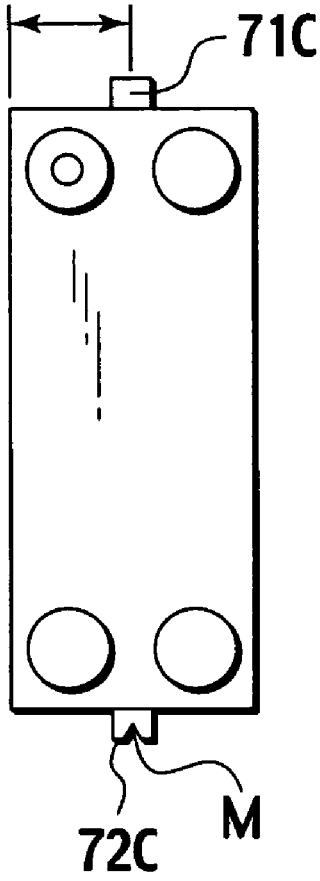

FIGS. 11A to 11C show projections 71A to 71C and 72A to 72C formed at different positions (distances LA, LB, and LC from an edge) to specify the types of second tanks (second tube sheets). Each projection is provided with or without a mark M to indicate whether the second tank is present at the end where the projection is formed or at the opposite end.

In this way, the identifiers may be changed in various ways to distinguish different types of second tanks from one another and to identify an end where the second tank is present.

To distinguish a plurality of types of second tanks from one another, at least one of the shape, size, and position of identifiers assigned to the types of second tanks may be differed from type to type. At the same time, any other one of the shape, size, and position of identifiers may be differed between opposite ends of each second tube sheet to identify an end where a second tank is present. This technique may eliminate the use of a mark on the identifiers.

According to the embodiments, the mark on an identifier is a notch. The present invention may use any other mark. For example, the mark may be a through hole, a recess, a projection, or the like.

According to the embodiments, the mark is provided at the end of the second tube sheet where the second tank is absent. The mark may be provided at the end of the second tube sheet where the second tank is present.

According to the embodiments, the identifier (projection) extends from each longitudinal end of a second tube sheet in a longitudinal direction. The identifier may be arranged at any position in the vicinity of each longitudinal end of a second tube sheet. For example, the identifier may extend from a longitudinal end of a second tube sheet in a direction orthogonal to the longitudinal direction.

Figure 12:
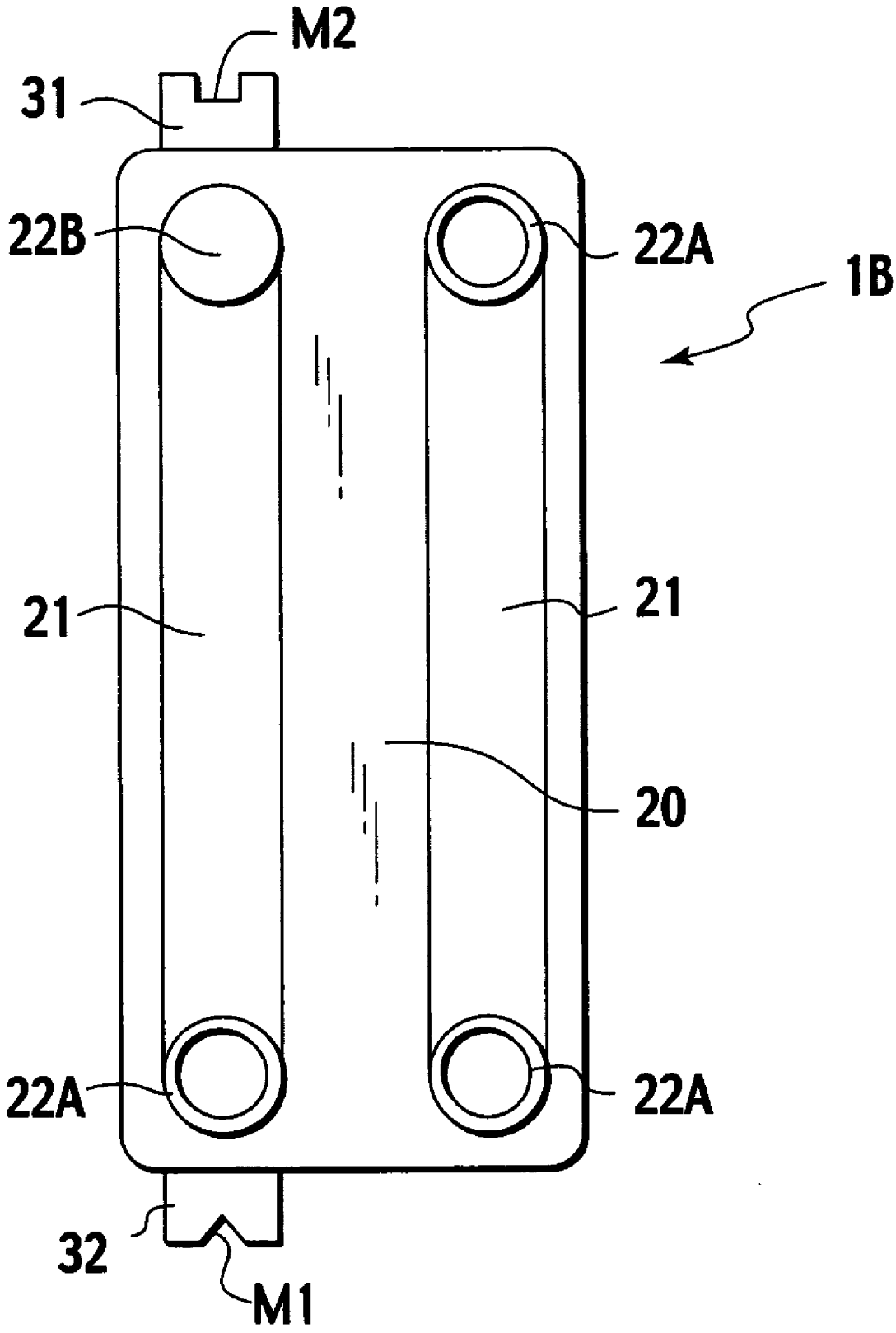
FIG. 12 is a view showing a modification of a second tube sheet.

According to the embodiments, the mark is provided on one of the identifiers. As shown in FIG. 12, the marks M1 and M2 may be provided at each end of the second tube sheet 1B. A first mark M1 is provided at the end where the second tank 22B is absent. A second mark M2, different from the first mark M1, is provided at the end where the second tank 22B is present.

The identifiers at each end of the second tube sheet may have different shapes, sizes, or positions, to serve for the first and second marks that are distinguishable from each other.

However, the first and second embodiments make the identifiers easily distinguishable from each other and avoid a mistake of identifying identifiers.

If there are a plurality of types of second tanks, the identifiers for identifying the types of second tanks are differed in the shape, size, or position thereof from type to type. At the same time, on each second tube sheet, identifiers arranged at the ends thereof are differed from each other in the shape, size, or position other than that used for identifying the types of second tanks, so that the identifiers on each second tube sheet may serve for the first and second marks, respectively. For example, (I) the identifiers are differed in the shape thereof from type to type to identify the types of second tube sheets, and on each second tube sheet, the identifiers are differed in the size or position thereof to serve as the first and second marks, respectively, (II) the identifiers are differed in the size thereof from type to type to identify the types of second tube sheets, and on each second tube sheet, the identifiers are differed in the shape or position thereof to serve as the first and second marks, respectively, or (III) the identifiers are differed in the position thereof from type to type to identify the types of second tube sheets, and on each second tube sheet, the identifiers are differed in the shape or size thereof to serve as the first and second marks, respectively.

Although the present invention has been described above by reference to certain embodiments of the invention, the invention is not limited to the embodiments described above. Modifications and variations of the embodiments can be made without departing from the spirit or scope of the appended claims. Therefore, the embodiments are only for an illustrative purpose and are not intended to limit the invention.

What is claimed is:

1. A heat exchanger, comprising:

a plurality of flat tubes stacked in layers, including each of the plurality of the flat tubes having a pair of tube sheets facing each other and joined together, the tube sheets have a flat part, a depressed recess part having end portions and extending in a longitudinal direction, and a cylindrical tank protruding from the end portions of the recess part, the tube sheet being one of a first tube sheet and a second tube sheet, the first tube sheet having a first type of tank positioned at each end thereof, the second tube sheet having the first type of tank at one end portion of the recess part and a second type of tank at the other end portion of the recess part, identifiers provided at each end of the second tube sheet, the identifiers distinguishing the second tube sheet from the first tube sheet when viewed externally of the stacked flat tubes, and a mark provided at one of the identifiers of the second tube sheet.

2. The heat exchanger of claim 1, wherein:

the mark is provided at the end of the second tube sheet where the second tank is absent.

3. The heat exchanger of claim 1, further comprising:

a plurality of types of second tanks distinguishable from type to type based on the identifiers; wherein the identifiers are assigned to the plurality of types of second tanks, respectively, and the identifiers are differed from type to type in at least one of shape, size, and position thereof.

4. The heat exchanger of 1, wherein:

each identifier is a projection protruding from each end of the second tube sheet.

5. The heat exchanger of claim 2, wherein:

each identifier is a projection protruding from each end of the second tube sheet.

6. The heat exchanger of claim 3, wherein:

each identifier is a projection protruding from each end of the second tube sheet.

7. A heat exchanger, comprising:

a plurality of flat tubes stacked in layers, including each of the plurality of the flat tubes having a pair of tube sheets facing each other and joined together, the tube sheets having a flat part, a depressed recess part having end portions and extending in a longitudinal direction, and a cylindrical tank protruding from the end portions of the recess part, the tube sheet being one of a first tube sheet and a second tube sheet, the first tube sheet having a first type of tank positioned at each end thereof, the second tube sheet having a first type of tank at one end portion of the recess part and a second type of tank at the other end portion of the recess part, identifiers provided at each end of the second tube sheet, the identifiers distinguishing the second tube sheet from the first tube sheet when viewed externally of the stacked flat tubes, a first mark provided at one of the identifiers of the second tube sheet, and a second mark provided at the other of the identifiers of the second tube sheet.

8. The heat exchanger of claim 1, wherein:

the first mark is provided at the end of the second tube sheet where the second tank is absent, and the second mark is provided at the end of the second tube sheet where the second tank is present.

9. The heat exchanger of claim 1, wherein:

the identifiers are formed at each end of the second tube sheet.

10. The heat exchanger of claim 1, wherein:

the first type of the tank at the one end and the second type of the tank at the other end are formed in a same outside shape or in a similar outside shape.

11. The heat exchanger of claim 7, wherein:

the identifiers are formed at each end of the second tube sheet.

12. The heat exchanger of claim 7, wherein:

the first type of the tank at the one end and the second type of the tank at the other end are formed in a same outside shape or in a similar outside shape.

* * * * *